US009613741B2

(12) United States Patent
Kim et al.

(10) Patent No.: US 9,613,741 B2
(45) Date of Patent: Apr. 4, 2017

(54) ELECTROMAGNETIC ACTUATOR

(71) Applicant: SAMSUNG ELECTRONICS CO., LTD., Suwon-si (KR)

(72) Inventors: Oui-serg Kim, Seongnam-si (KR); Sang-hoon Kim, Suwon-si (KR); Hyo-soo Kim, Hwaseong-si (KR); Kun-bum Park, Seoul (KR); Jong-Ho Park, Seoul (KR); Young-hwan Yoon, Seoul (KR); Jeong-sik Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/603,860

(22) Filed: Jan. 23, 2015

(65) Prior Publication Data

US 2015/0287509 A1 Oct. 8, 2015

(30) Foreign Application Priority Data

Apr. 7, 2014 (KR) ..... 10-2014-0041500

(51) Int. Cl.
*H01F 7/13* (2006.01)
*H01F 7/20* (2006.01)

(52) U.S. Cl.
CPC ..... *H01F 7/206* (2013.01); *H01F 2007/208* (2013.01)

(58) Field of Classification Search
CPC ..... H01F 7/206; H01F 2007/208
USPC ..... 335/285–295; 269/8
See application file for complete search history.

(56) References Cited

U.S. PATENT DOCUMENTS 3,316,514 A * 4/1967 Radus ..... H01F 7/206 335/291
4,307,668 A 12/1981 Vinson
4,965,695 A * 10/1990 Baumann ..... H01F 7/04 294/65.5
6,635,976 B2 10/2003 Kanebako et al.
(Continued)

FOREIGN PATENT DOCUMENTS

JP 3314908 B2 6/2002
JP 2004-266217 A 9/2004
(Continued)

OTHER PUBLICATIONS

Han, et al.; "The High Precision Linear Motion Table with a Novel Rare Earth Permanent Magnet Biased Magnetic Bearing Suspension", 4 pages total.

*Primary Examiner* — Ramon M Barrera
(74) *Attorney, Agent, or Firm* — Sughrue Mion, PLLC

(57) ABSTRACT

An electromagnetic actuator includes a first body which includes a biased permanent magnet, a magnetic path control device which is disposed to adjust a magnetic path produced by the biased permanent magnet, at least one core which is disposed to face the biased permanent magnet and the magnetic path control device, and a coil which is wound on the at least one core so as to reinforce or cancel the magnetic path produced by the biased permanent magnet; and a second body which is separated from the biased permanent magnet and the magnetic path control device when the at least one core is between the second body and at least one of the biased permanent magnet and the magnetic path control device.

9 Claims, 10 Drawing Sheets

(56) References Cited

U.S. PATENT DOCUMENTS

| | | | | |
|---|---|---|---|---|
| 6,639,499 | B2 | 10/2003 | Okita et al. | |
| 8,476,797 | B2 | 7/2013 | Jang et al. | |
| 2009/0072644 | A1 | 3/2009 | Han et al. | |
| 2013/0009501 | A1 | 1/2013 | Park et al. | |
| 2013/0135067 | A1* | 5/2013 | Choi | H01F 7/206 335/290 |

FOREIGN PATENT DOCUMENTS

| | | | |
|---|---|---|---|
| JP | 2006-220506 | A | 8/2006 |
| KR | 10-0588043 | B1 | 6/2006 |
| KR | 10-1064226 | B1 | 9/2011 |
| KR | 10-1166854 | B1 | 7/2012 |
| KR | 10-1287057 | B1 | 7/2013 |

* cited by examiner

ELECTROMAGNETIC ACTUATOR

CROSS-REFERENCE TO RELATED APPLICATIONS

This application claims priority from Korean Patent Application No. 10-2014-0041500, filed on Apr. 7, 2014, in the Korean Intellectual Property Office, the disclosure of which is incorporated herein in its entirety by reference.

BACKGROUND

Exemplary embodiments relate to an electromagnetic actuator. In particular, exemplary embodiments relate to an electromagnetic actuator using a biased permanent magnet.

An electromagnetic actuator may keep an object in a floating state using an electromagnet. In order to increase a support weight of the electromagnetic actuator, a high bias current needs to be supplied to a coil of the electromagnet actuator. However, there is a limitation in the magnitude of the supplied high bias current due to an increase in heat generation. Therefore, in order to overcome an issue of increased heat generation, an electromagnetic actuator using a bias type permanent magnet may be provided.

SUMMARY

The exemplary embodiments may provide an electromagnetic actuator capable of overcoming a limitation in the magnitude of a supplied current and easily and stably achieve an initial floating state.

According to an aspect of the exemplary embodiments, there is provided an electromagnetic actuator including: a first body which includes a biased permanent magnet, a magnetic path control device which is disposed to adjust a magnetic path produced by the biased permanent magnet, at least one core which is disposed to face the biased permanent magnet and the magnetic path control device, and a coil which is wound on the at least one core so as to reinforce or cancel the magnetic path produced by the biased permanent magnet; and a second body which is separated from the biased permanent magnet and the magnetic path control device when the at least one core is between the second body and at least one of the biased permanent magnet and the magnetic path control device.

The magnetic path control device may be a permanent magnet.

The magnetic path control device may be an electromagnet.

A plurality of cores may be disposed to face each other, and the biased permanent magnet and the magnetic path control device may be disposed between the plurality of cores.

The coil may be wound so as to surround the plurality of cores.

The coil may be respectively wound on each of the plurality of cores.

Each of the plurality of cores may include a plurality of protrusions which protrude toward the second body so that the magnetic path produced by the biased permanent magnet passes through the second body, and the coil may be wound on at least one of the protrusions.

The first body may be a carrier and a second body may be a rail.

The first body may be a hollow cylinder and the second body may be a rotating object.

The magnetic path control device may make a portion of the magnetic path pass through the biased permanent magnet only instead of both the biased permanent magnet and the second body.

According to another aspect of the exemplary embodiments, there is provided an electromagnetic actuator including: a first body which includes a biased permanent magnet and a magnetic path control device which is disposed to adjust a magnetic path produced by the biased permanent magnet; and a second body which includes a first core which faces the first body, and a first coil which is wound on the first core so as to reinforce or cancel the magnetic path produced by the biased permanent magnet.

The first core may include at least one protrusion which protrudes toward the first body so that the magnetic path produced by the biased permanent magnet passes through the second body, and the first coil may be wound on the at least one protrusion of the first core.

The first core may include a plurality of protrusions which protrude toward the first body so that the magnetic path produced by the biased permanent magnet passes through the second body, and the first coil may be wound on a core body which connect each of the protrusions of the first core.

The first body may further include a second core which faces the second body.

The electromagnetic actuator may further include a second coil which is wound on the second core for reinforcing or cancelling the magnetic path produced by the biased permanent magnet.

According to yet another aspect of the exemplary embodiments, there is provided a rotational electromagnetic actuator including: a hollow cylinder; a rotating object which floats from the hollow cylinder by applying a bias current; at least one biased permanent magnet which faces the rotating object and connects to the hollow cylinder; and at least one magnetic path control device which is disposed adjacent to the at least one biased permanent magnet.

BRIEF DESCRIPTION OF THE DRAWINGS

Exemplary embodiments will be more clearly understood from the following detailed description taken in conjunction with the accompanying drawings in which.

DETAILED DESCRIPTION OF THE EXEMPLARY EMBODIMENTS

Figure 1A:
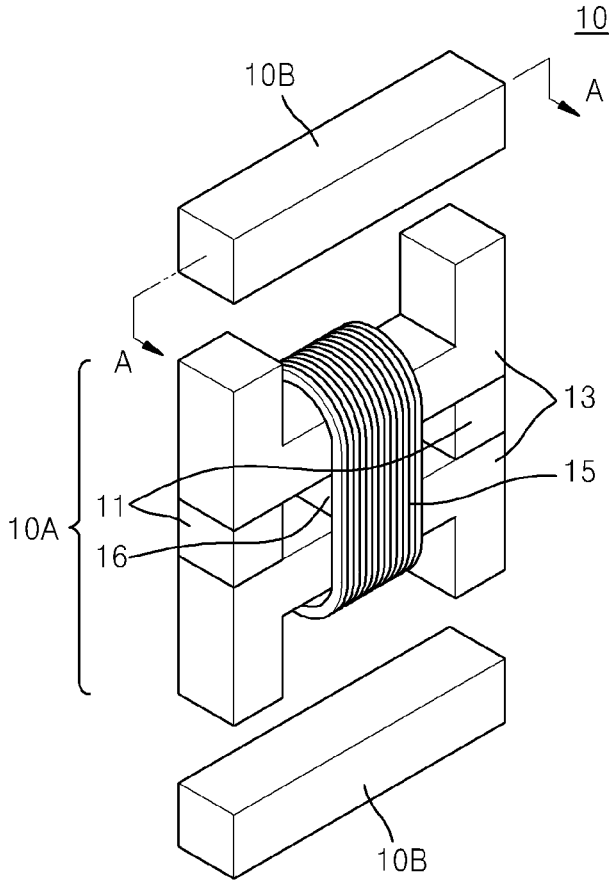
FIG. 1A is a perspective view of an electromagnetic actuator according to an exemplary embodiment.

Hereinafter, the present invention will be described in detail by explaining exemplary embodiments of the invention with reference to the attached drawings. Like reference numerals in the drawings denote like elements.

This inventive concept may, however, be embodied in many different forms and should not be construed as limited to the exemplary embodiments set forth herein. Rather, these exemplary embodiments are provided so that this disclosure will be thorough and complete, and will fully convey the scope of the inventive concept to those skilled in the art.

It will be understood that, although the terms 'first', 'second', 'third', etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept. For example, a first element may be designated as a second element. Similarly, a second element may be designated as a first element without departing from the teachings of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

If an exemplary embodiment is realized in a different manner, a specified operation order may be performed in a different manner from a described order. For example, two consecutive operations may be substantially simultaneously performed, or in an order opposite to the described order.

Variations from the shapes of the illustrations as a result, for example, of manufacturing techniques and/or tolerances, are to be expected. Thus, embodiments of the inventive concept should not be construed as limited to the particular shapes of regions illustrated herein but are to include deviations in shapes that result, for example, from manufacturing. As used herein, the term "and/or" includes any and all combinations of one or more of the associated listed items. Expressions such as "at least one of," when preceding a list of elements, modify the entire list of elements and do not modify the individual elements of the list.

Figure 1B:
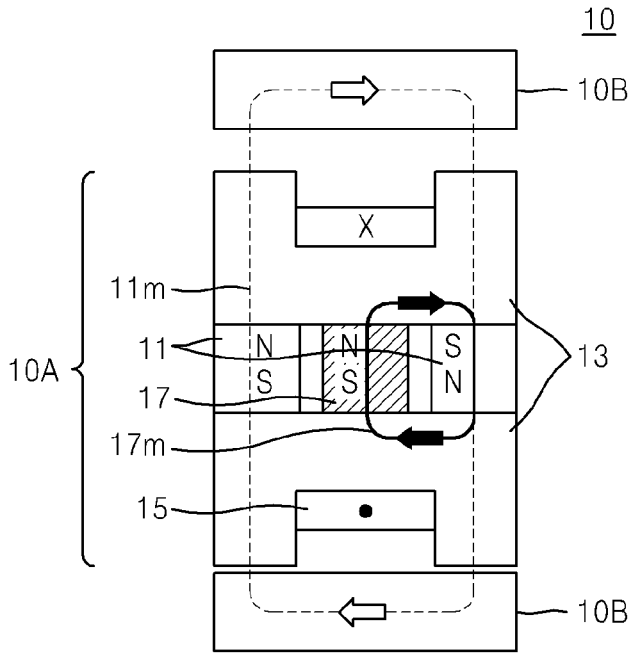
FIG. 1B is a cross-sectional view of the electromagnetic actuator in a mounted state according to an exemplary embodiment.
Figure 1C:
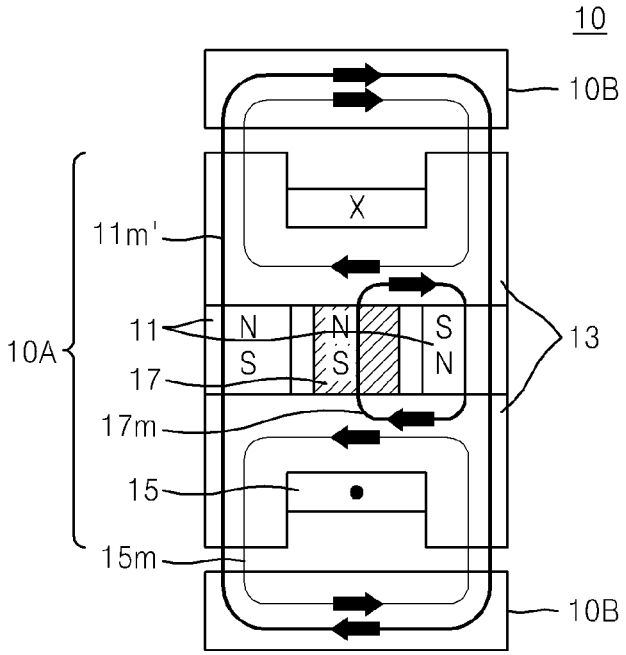
FIG. 1C is a cross-sectional view of the electromagnetic actuator in a floating state according to an exemplary embodiment.

FIG. 1A is a perspective view of an electromagnetic actuator 10 according to an exemplary embodiment. FIGS. 1B and 1C are cross-sectional views of the electromagnetic actuator 10 taken along line "A-A" of FIG. 1A.

Referring to FIG. 1A, in the electromagnetic actuator 10 according to the exemplary embodiment, a first body 10A floats between second bodies 10B. The first body 10A includes two biased permanent magnets 11, two C-shaped cores 13 (e.g., two cores 13) which are respectively connected to opposite magnetic poles of the biased permanent magnets 11, a coil 15 that is wound to simultaneously surround core bodies of the two cores 13, wherein the core body connects two protrusions of each core 13, and a magnetic path control device 16 disposed between the biased permanent magnets 11 and the cores 13. The second body 10B is disposed to face the protrusion of the core 13. In the exemplary embodiment, the magnetic path control device 16 may be a permanent magnet or an electromagnet.

FIG. 1B is a cross-sectional view of the electromagnetic actuator 10 in a mounted state according to the exemplary embodiment. FIG. 1B shows a cross-section of the electromagnetic actuator 10 taken along line A-A of FIG. 1A. In FIGS. 1A through 11B, like reference numerals denote like components and descriptions about the same components will not be repeated.

FIG. 1B shows a state before the first body 10A floats from a lower portion of the second body 10B. The first body 10A is mounted on the lower portion of the second body 10B. The mounted status of the electromagnetic actuator 10 will be described in accordance with a permanent magnet path 11*m* produced by the biased permanent magnets 11 and an induced magnetic path 17*m* produced by the magnetic path permanent magnet 17.

The biased permanent magnets 11 included in the first body 10A are disposed to face rear surfaces of the two protrusions of the cores 13 so that the permanent magnet path 11*m* produced by the permanent magnets 11 may pass through the cores 13. A plurality of biased permanent magnets 11 may be disposed in order to increase a support load of the electromagnetic actuator 10. In FIG. 1B, two biased permanent magnets 11 are disposed to form magnetic paths in the same direction. That is, the permanent magnet path 11*m* has a closed path that passes through the biased permanent magnets 11, the protrusions of the cores 13, and the second body 10B.

The magnetic path control permanent magnet 17 is disposed adjacent to the permanent magnet path 11*m* so as to reduce an intensity of the magnetic flux caused by the biased permanent magnet 11. In particular, the magnetic path control permanent magnet 17 is disposed to face the cores 13 so that the induced magnetic path 17*m* formed between the magnetic path control permanent magnet 17 and the biased permanent magnet 11 may pass through the cores 13. That is, the induced magnetic path 17*m* has a closed path passing through the biased permanent magnet 11, the cores 13, and the magnetic path control permanent magnet 17. The magnetic path control permanent magnet 17 is provided to intentionally form the induced magnetic path 17*m* so that a part of the magnetic flux of the permanent magnet path 11*m*, which passes through the second body 10B, may pass through the inside of the first body 10A. Accordingly, a contact attraction force between the first body 10A and the second body 10B may be reduced. Therefore, the first body 10A can easily counteract the contact attraction force at an initial stage of floating. Thus, the first body 10A may stably float.

In FIG. 1B, the first body 10A is coupled to the lower portion of the second body 10B in an initial mounted state in which an electric current is not supplied. However, the first body 10A may be coupled to an upper portion of the second body 10B by a magnetic force between the biased permanent magnet 11 and the upper portion of the second body 10B.

Also, in FIG. 1B, the biased permanent magnet 11 and the magnetic path control permanent magnet 17 are connected to the cores 13. However, the exemplary embodiments are not limited thereto. That is, the biased permanent magnet 11 may be disposed so that a magnetic pole of the biased permanent magnet 11 may be separated from the cores 13 while facing the cores 13. Further, the magnetic path control permanent magnet 17 may be disposed so that the magnetic pole of the biased permanent magnet 11 is separated from the cores 13 while facing the cores 13.

Also, in FIG. 1B, two biased permanent magnets 11 and one magnetic path control permanent magnet 17 are disposed. However, the exemplary embodiments are not limited thereto. That is, one, three, or more biased permanent magnets 11 may be disposed and two or more magnetic path control permanent magnets 17 may be disposed.

FIG. 1C is a cross-sectional view of the electromagnetic actuator 10 in a floating state according to the exemplary embodiment.

Referring to FIG. 1C, a bias current is applied to the electromagnetic actuator 10 to make the first body 10A float from the second body 10B. The floating state of the electromagnetic actuator 10 will be described in accordance with a permanent magnet path 11*m*' produced by the biased permanent magnet 11, an electromagnet path 15*m* produced by the coil 15, and the induced magnetic path 17*m* produced by the magnetic path control permanent magnet 17.

The permanent magnet path 11*m*' produced by the biased permanent magnet 11 is formed in a clockwise direction after passing through the second body 10B via the cores 13 connected to the biased permanent magnet 11. When the bias current is supplied to the coil 15 that is wound to simultaneously surround the two cores 13, the electromagnet paths 15*m* passing through the cores 13 and the second body 10B are formed. Here, the electromagnet paths 15*m* are formed on upper and lower portions based on the biased permanent magnet 11. The electromagnet path 15*m* formed on the upper portion is formed in a clockwise direction, and the electromagnet path 15*m* formed on the lower portion is formed in a counter-clockwise direction. Accordingly, the magnetic flux density is increased in the upper portion of the second body 10B because the permanent magnet path 11*m*' and the electromagnet path 15*m* is reinforced in the upper portion of the second body 10B, and the magnetic flux density is decreased in the lower portion of the second body 10B because the permanent magnet path 11*m*' and the electromagnet path 15*m* is cancelled in the lower portion of the second body 10B. Therefore, the first body 10A floats from the lower portion of the second body 10B to the upper portion of the second body 10B due to the electromagnetic force.

In the above processes, the magnetic path control permanent magnet 17 that is disposed adjacent to the biased permanent magnet 11 forms the induced magnetic path 17*m* so that a part of the magnetic flux produced by the biased permanent magnet 11 detours inside the first body 10A. Accordingly, an intensity of the magnetic flux of the permanent magnet path 11*m*' may be reduced. Further, the intensity of the magnetic flux of the electromagnet path 15*m*, which is necessary for cancelling the magnetic flux of the permanent magnetic path 11*m*', is also reduced. Therefore, a magnitude of the bias current that has to be supplied to the coil 15 in order to float the first body 10A may be reduced. That is, even if the load of the floating body in the electromagnetic actuator is large, the magnitude of the bias current that has to be supplied may be reduced. Therefore, heat generation is reduced due to the reduced magnitude of the bias current that has to be supplied.

Figure 2:
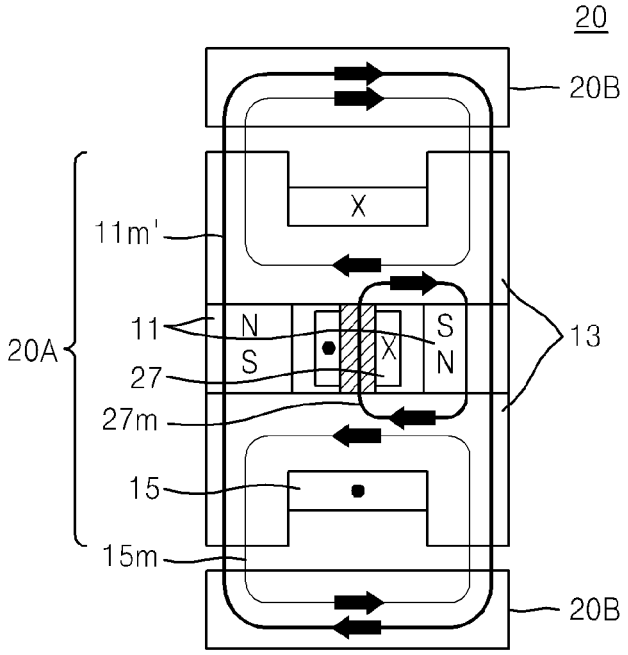
FIGS. 2 through 9 are cross-sectional views of an electromagnetic actuator according to the exemplary embodiments.

FIG. 2 is a cross-sectional view of an electromagnetic actuator 20 in a floating state according to an exemplary embodiment.

Referring to FIG. 2, the electromagnetic actuator 20 is similar to the electromagnetic actuator 10 described with reference to FIGS. 1A through 1C, except that an electromagnet 27 is used as a magnetic path control device in the electromagnetic actuator 20.

The permanent magnet path 11*m*' is formed in a clockwise direction after transmitting through the second body 20B via the cores 13 connected to the biased permanent magnet 11. The electromagnet path 15*m* is formed to pass through the cores 13 and the second body 20B when the bias current is supplied to the coil 15. The first body 20A may float from the lower portion to the upper portion of the second body 20B due to the reinforcing and cancelling of the magnetic flux between the permanent magnet path 11*m*' and the electromagnet path 15*m*.

During this process, the electromagnet 27 used as the magnetic path control device forms an induced magnetic path 27*m* to reduce the intensity of the magnetic flux of the permanent magnet path 11*m'*.

The electromagnet 27 is disposed adjacent to the biased permanent magnet 11. The electromagnet 27 is disposed to have a magnetic pole direction so that the induced magnetic path 27*m* of a closed path may be formed between the electromagnet 27 and the biased permanent magnet 11 adjacent thereto. Accordingly, a part of the magnetic flux generated by the biased permanent magnet 11 may detour inside the first body 20A so that the intensity of the magnetic flux of the permanent magnet path 11*m*' may be reduced. Therefore, the magnitude of the bias current may be limited in order to reduce heat generation.

Figure 3:
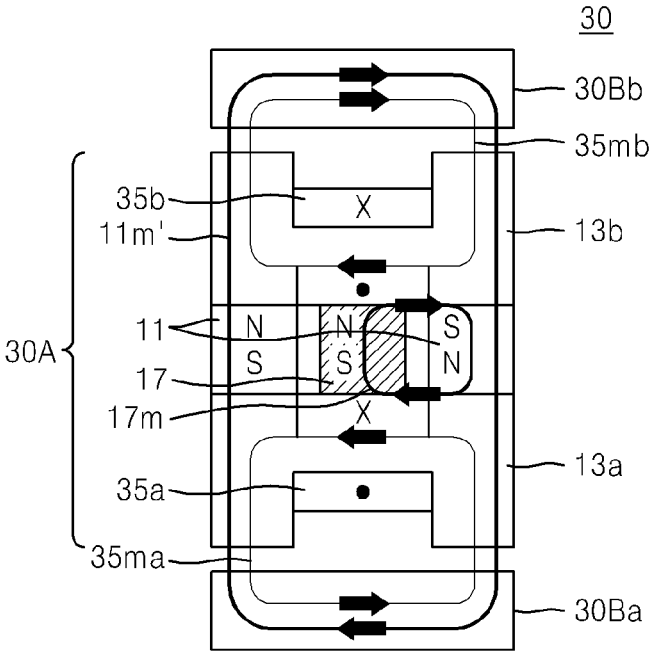

FIG. 3 is a cross-sectional view of an electromagnetic actuator 30 in a floating state according to an exemplary embodiment.

Referring to FIG. 3, the electromagnetic actuator 30 is similar to the electromagnetic actuator 10 described with reference to FIGS. 1A through 1C except that an upper coil 35*b* and a lower coil 35*a* are respectively wound on an upper core 13*b* and a lower core 13*a*.

Upper and lower portions are classified based on the biased permanent magnet 11, and the lower coil 35*a* wound on the lower core 13*a* forms a lower electromagnetic path 35*ma* and the upper coil 35*b* wound on the upper core 13*b* forms an upper electromagnetic path 35*mb*.

The permanent magnet path 11*m*' is formed in the clockwise direction while transmitting a second body 30B via the lower core 13*a* and the upper core 13*b* connected to the biased permanent magnet 11. When a bias current is supplied to the lower coil 35*a* and the upper coil 35*b*, the lower electromagnetic path 35*ma* is formed to transmit through the lower core 13*a* and a lower second body 30Ba, and the upper electromagnetic path 35*mb* is formed to transmit through the upper core 13*b* and an upper second body 30Bb. The magnetic flux is cancelled in the permanent magnet path 11*m*' and the lower electromagnetic path 35*ma*, and the magnetic flux is reinforced in the permanent magnet path 11*m*' and the upper electromagnetic path 35*mb* so that the first body 30A may float from the lower second body 30Ba to the upper second body 30Bb due to the electromagnetic force. As described above, when the plurality of coils 35*a* and 35*b* are respectively wound on the plurality of cores 13*a* and 13*b*, the electromagnetic paths 35*ma* and 35*mb* along which a greater magnetic flux is generated may be obtained by supplying the same bias current. The electromagnetic actuator 30 allows the first body 30A to counteract the contact attraction force generated by the biased permanent magnet 11 and to float from the second bodies 30Ba and 30Bb along an original path.

The permanent magnet 17 used as the magnetic path control device forms the induced magnetic path 17*m* to adjust the intensity of the magnetic flux of the permanent magnet path 11*m'*.

Figure 4:
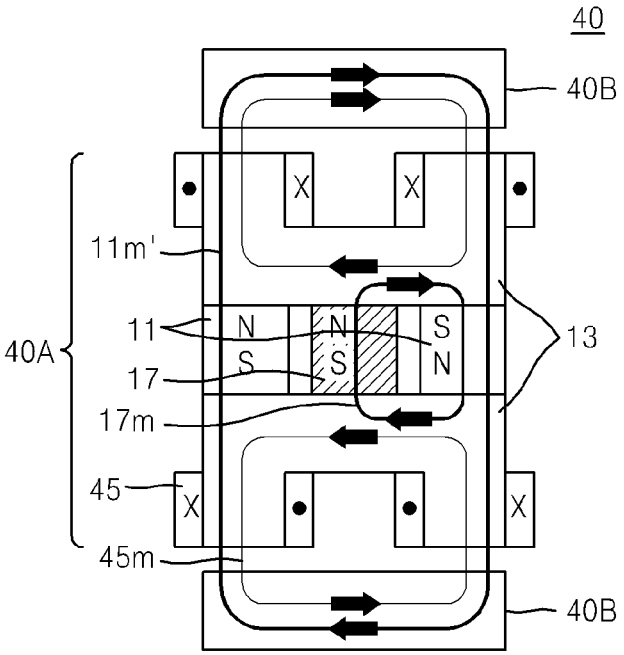

FIG. 4 is a cross-sectional view of an electromagnetic actuator 40 in a floating state according to an exemplary embodiment.

Referring to FIG. 4, the electromagnetic actuator 40 is similar to the electromagnetic actuator 10 described with reference to FIGS. 1A through 1C except that a plurality of coils 45 are wound on the cores 13 at different locations in the electromagnetic actuator 40.

The core 13 has a 'C' shape and includes two protrusions and a core body connecting the two protrusions. The plurality of coils 45 is respectively wound on the two protrusions to form electromagnetic paths 45*m*.

The coils 45 are wound on the core 13 in a direction so that a first body 40A may float from a lower portion to an upper portion of the second body 40B due to the electromagnetic force. Accordingly, the directions in which the coils 45 are wound are set so that the magnetic flux between the permanent magnet path 11*m*' on the upper portion based on a location where the biased permanent magnet 11 is disposed and the electromagnetic path 45*m* may be reinforced, and the magnetic flux between the permanent magnet path 11*m*' on the lower portion and the electromagnetic path 45*m* may be offset.

If the plurality of coils 45 is wound on the core 13 like in the electromagnetic actuator 40, the electromagnetic path 45*m* having a large flux intensity may be obtained. Thus, the first body 40A may easily float from the second body 40B.

In FIG. 4, the coils 45 are wound on each of the two protrusions of the core 13. However, the exemplary embodiments are not limited thereto. That is, the coils 45 may be wound only on one of the two protrusions. In some exemplary embodiments, the core 13 may include three or more protrusions, and the coils 45 may be wound on at least one of the protrusions.

Figure 5:
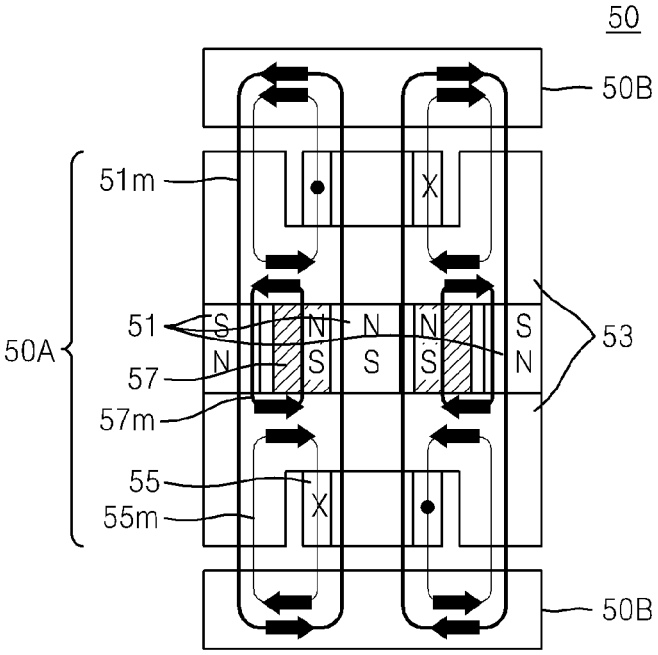

FIG. 5 is a cross-sectional view of an electromagnetic actuator 50 in a floating state according to an exemplary embodiment.

Referring to FIG. 5, the electromagnetic actuator 50 is similar to the electromagnetic actuator 10 described with reference to FIGS. 1A through 1C. However, shapes and arrangements of a biased permanent magnet 51, a core 53, a coil 55 wound on the core 53, and a magnetic path control permanent magnet 57 are different from those of FIGS. 1A through 1C.

The biased permanent magnet 51 included in a first body 50A is disposed to face a rear surface of protrusions of the core 53 so that a permanent magnet path 51*m* produced by the biased permanent magnet 51 may pass through the core 53. The core 53 is formed to have an 'E' shape including three protrusions and a core body connecting the three protrusions. The biased permanent magnet 51 forms the permanent magnet paths 51*m* that pass through an outer protrusion and a center protrusion from among the three protrusions of the core 53 at left and right sides of the first body 50A. The electromagnetic actuator 50 includes three biased permanent magnets 51, that is, including one more biased permanent magnet 51 being disposed on a rear surface of the center protrusion in order to form the permanent magnet path 51*m*.

The coil 55 is wound on the center protrusion of the core 53. An electromagnet path 55*m* produced by the coil 55 is configured to pass through the outer protrusion of the core 53, the second body 50B, and the center protrusion. The coil 55 is wound in a direction so that the magnetic flux between the permanent magnet path 51*m* and the electromagnetic path 55*m* is reinforced on an upper portion of the second body 50B and cancelled on a lower portion of the second body 50B.

The magnetic path control permanent magnet 57 is disposed adjacent to the biased permanent magnet 51 so as to reduce an intensity of a magnetic field produced by the biased permanent magnet 51. In particular, the magnetic path control permanent magnet 57 is disposed to face the core 53 so that an induced magnetic path 57*m* formed between the magnetic path control permanent magnet 57 and the biased permanent magnet 51 may pass through the core 53. Also, two magnetic path control permanent magnets 57 may be disposed to be adjacent to the biased permanent magnets 51 disposed on left and right sides so as to reduce the magnetic flux intensities along the permanent magnet paths 51*m* formed on the left and right sides. However, since the magnetic path control permanent magnet 57 is not essential with respect to every permanent magnet path 51*m* in the electromagnetic actuator 50, one magnetic path control permanent magnet 57 for only one of the permanent magnetic paths 51*m* may be disposed. That is, the magnetic path control device may not be disposed in some of the permanent magnet path 51*m* from among the plurality of permanent magnet paths 51*m* in order to reinforce the magnetic flux intensity of the permanent magnet path 51*m*, and a plurality of magnetic path control devices may be disposed on one permanent magnet path 51*m* in order to weaken the magnetic flux intensity of the permanent magnet path 51*m*.

The induced magnetic path 57*m* is produced by providing the magnetic path control permanent magnet 57 so that a part of the magnetic path of the permanent magnet path 51*m* that passes through the second body 50B may be induced to pass through the first body 51A and the magnetic flux intensity of the permanent magnet path 51*m* may be weakened.

Figure 6:
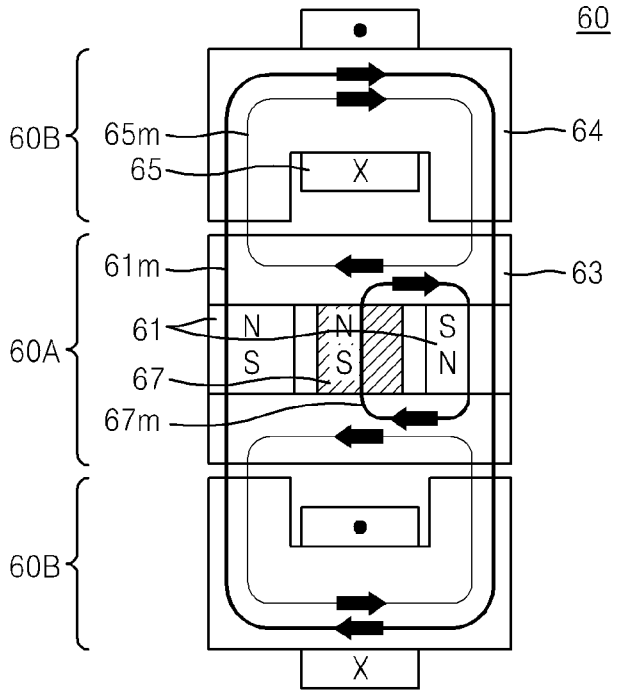

FIG. 6 is a cross-sectional view of an electromagnetic actuator 60 in a floating state according an exemplary embodiment.

Referring to FIG. 6, a bias current may be applied to the electromagnetic actuator 60 to make a first body 60A float from a second body 60B.

A biased permanent magnet 61 included in the first body 60A is disposed so that a permanent magnet path 61*m* produced by the biased permanent magnet 61 may pass through a first core 63. In FIG. 6, the first core 63 does not include a protrusion. However, the first core 63 may include a protrusion having a cross-section facing the second body 60B in some exemplary embodiments.

A permanent magnet control permanent magnet 67 is disposed adjacent to the biased permanent magnet 61 to form a magnetic path 67*m*, so that a magnetic flux intensity along the permanent magnet path 61*m* may be weakened.

The second body 60B includes a second core 64 having a 'C' shape. The second core 64 includes a protrusion having a cross-section facing the first body 60A. The permanent magnet path 61*m* may be formed to pass through the second core 64.

A coil 65 is wound on a core body connecting the protrusions of the second core 64. When the bias current is supplied to the coil 65, an electromagnetic path 65*m* passing through the first core 63 and the second body 60B is formed. In this case, the electromagnetic path 65*m* is formed on upper and lower portions of the biased permanent magnet 11. The magnetic flux of the electromagnetic path 65*m* and the magnetic flux of the permanent magnet path 61 are reinforced or cancelled so that the first body 60A floats from the second body 60B.

Figure 7:
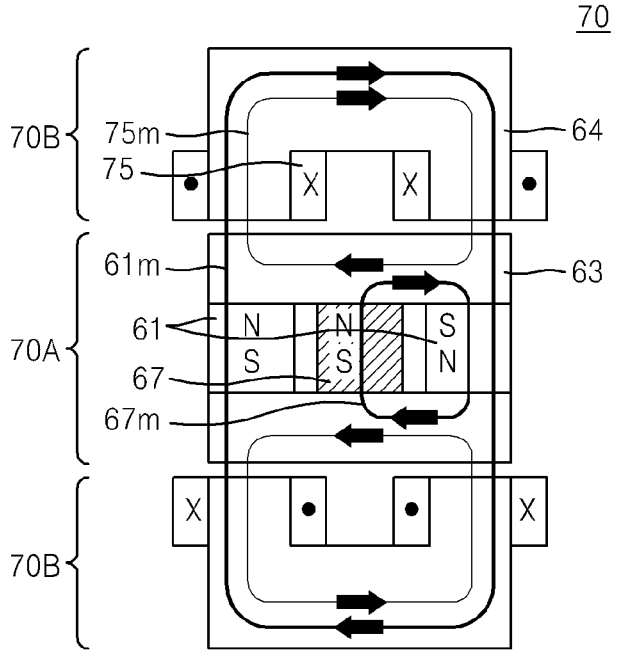

FIG. 7 is a cross-sectional view of an electromagnetic actuator 70 in a floating state according to an exemplary embodiment.

Referring to FIG. 7, the electromagnetic actuator 70 of the present embodiment is similar to the electromagnetic actuator 60 of FIG. 6 except that a coil 75 is wound on protrusions of the second core 64. When the bias current is supplied to the coil 75, an electromagnetic path 75*m* passing through a first core 63 and the second body 70B is formed. In some embodiments, the second core 64 may include at least one protrusion, and the coil 75 may be wound entirely or partially on the protrusion.

Figure 8:
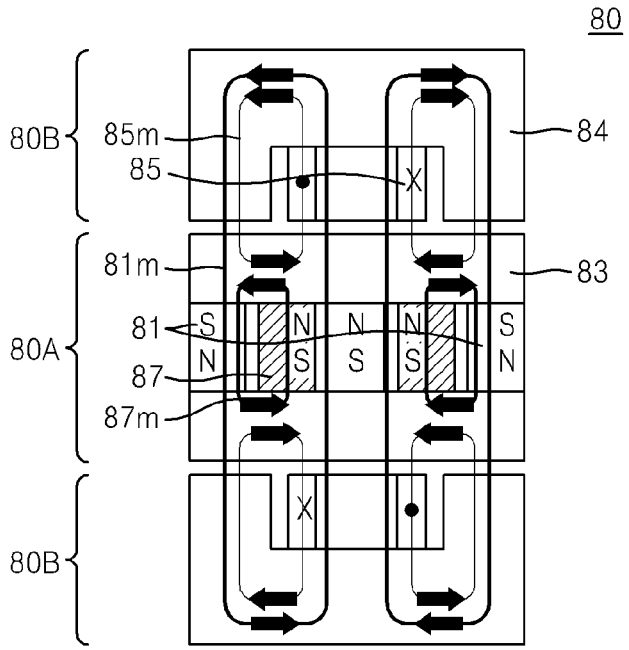

FIG. 8 is a cross-sectional view of an electromagnetic actuator 80 in a floating state according to an exemplary embodiment.

Referring to FIG. 8, the electromagnetic actuator 80 is similar to the electromagnetic actuator 60 shown in FIG. 6. However, shapes or arrangements of a biased permanent magnet 81, a second core 84, a coil 85 wound on the second core 84, and a magnetic path control permanent magnet 87 are different from those of the previous embodiments.

The biased permanent magnet 81 included in a first body 80A is disposed so that a permanent magnet path 81*m* produced by the biased permanent magnet 81 may pass through a first core 83 and the second core 84. The second core 84 has an E-shape including three protrusions and a core body connecting the three protrusions. The biased permanent magnet 81 forms the permanent magnet paths 81*m* passing through an outer protrusion and a center protrusion from among the three protrusions of the second core 84 at left and right sides thereof.

An additional biased permanent magnet 81 may be disposed on a rear surface of the first core 83 in order to form the permanent magnet path 81*m*. In this case, the additional biased permanent magnet 81 may be disposed on an extension from the center protrusion of the second core 84.

The coil 85 is wound on the center protrusion of the second core 84. An electromagnetic path 85*m* produced by the coil 85 is formed to pass through the outer protrusion of the second core 84, the first core 83, and the center protrusion of the second core 84. The coil 85 is wound in a direction so that magnetic fluxes of the permanent magnet path 81*m* and the electromagnetic path 85*m* are reinforced in the second core 84 on an upper portion of the point where the permanent magnet path 81*m* and the electromagnetic path 85*m* meet each other and cancelled in the second core 84 on a lower portion.

In order to weaken the magnetic flux intensities of the permanent magnet paths 81*m* produced on the left and right sides by the biased permanent magnet 81, two magnetic path control permanent magnets 87 may be disposed adjacent to the biased permanent magnets 81 on the left and right sides. Accordingly, the induced magnetic path 87*m* is formed as described above.

Figure 9:
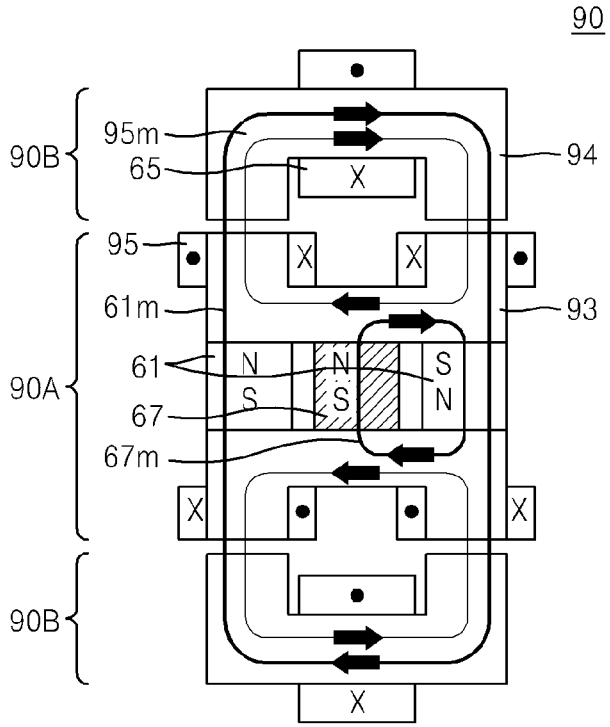

FIG. 9 is a cross-sectional view of an electromagnetic actuator 90 in a floating state according to an exemplary embodiment.

Referring to FIG. 9, the electromagnetic actuator 90 is similar to the electromagnetic actuator 60 of FIG. 6 except for a shape of a first core 93 and an additional first coil 95 wound on the first core 93.

The biased permanent magnet 61 included in a first body 90A is disposed so that the permanent magnet path 61*m* produced by the biased permanent magnet 61 passes through the first core 93. The first core 93 is formed to have a 'C' shape including two protrusions having cross-sections facing a second body 90B and a core body connecting the two protrusions. The first coil 95 is wound on each of the two protrusions.

The second body 90B includes a C-shaped second core 94. The second core 94 includes protrusions having cross-sections facing the first body 90A. The second coil 65 is wound on a core body that connects the protrusions of the second core 94. When the bias current is supplied to the first coil 95 and the second coil 65, an electromagnetic path 95*m* passing through the first core 93 and the second core 94 is formed. The electromagnetic actuator 90 generates a large magnetic flux intensity because the electromagnetic path 95*m* is produced by the plurality of coils, that is, the first coil 95 and the second coil 65. Thus, the first body 90A may easily float from the second body 90B.

Figure 10A:
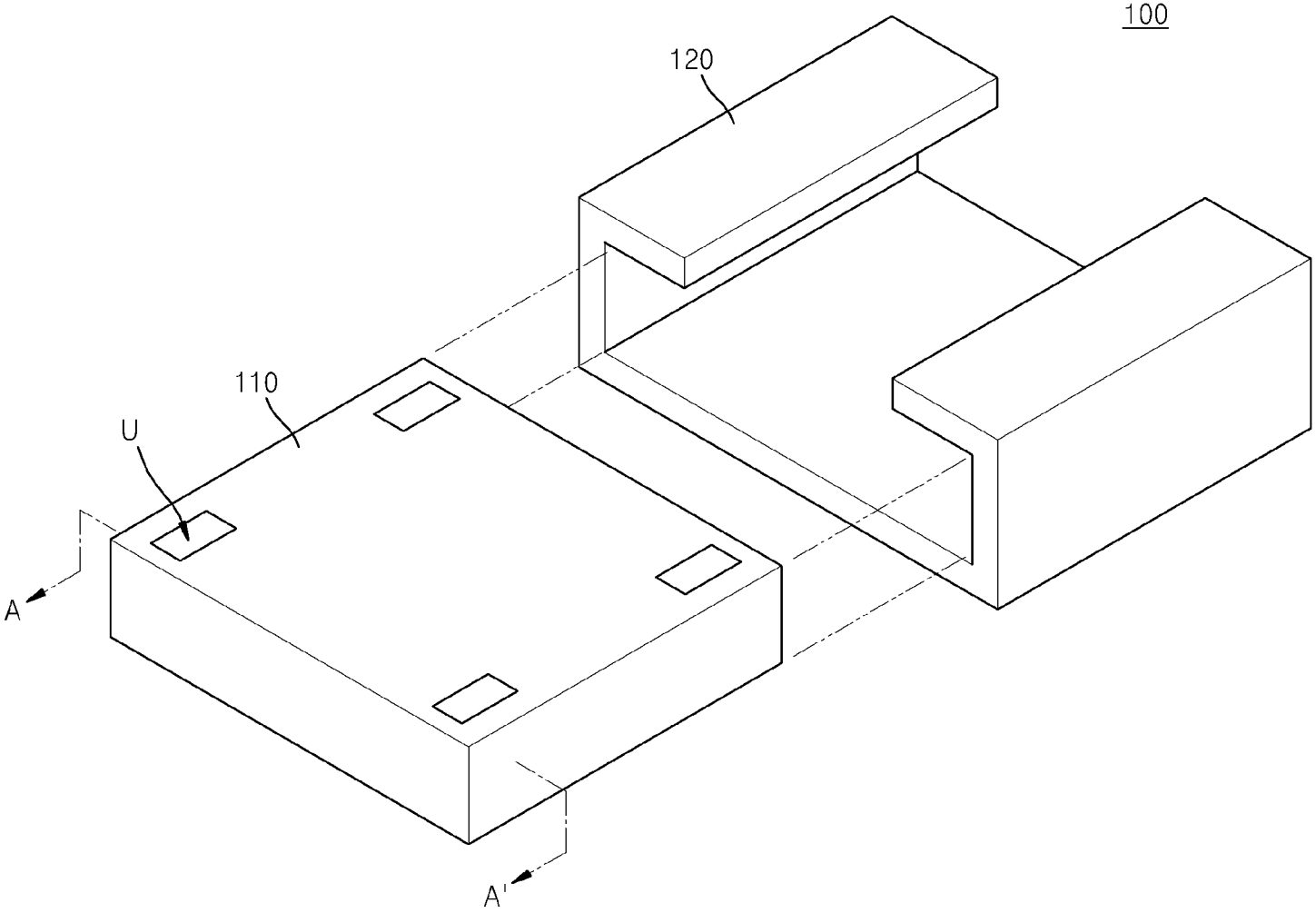
FIGS. 10A and 10B are a perspective view and a cross-sectional view of an electromagnetic actuator for linear movement, according to the exemplary embodiments.

FIG. 10A is a perspective view of a linear electromagnetic actuator 100 according to an exemplary embodiment.

Referring to FIG. 10A, the linear electromagnetic actuator 100 is in a state where a first body 110 floats from a second body 120 by applying a bias current to the linear electromagnetic actuator 100. An outer wall of the first body 110 faces an inner wall of the second body 120.

The first body 110 may include at least one electromagnetic actuator unit U. In some exemplary embodiments, the electromagnetic actuator unit U may be the first body in the electromagnetic actuators 10, 20, 30, 40, 50, 60, 70, 80, and 90 of FIGS. 1A through 9.

In the linear electromagnetic actuator 100, the first body 110 is coupled to a lower or an upper portion of the second body 120 due to a magnetic force of a permanent magnet included in the electromagnetic actuator unit U before the bias current is applied to the electromagnetic actuator 100. In addition, when the bias current is supplied to the linear electromagnetic actuator 100, an electromagnetic force of an electromagnet included in the electromagnetic actuator unit U is additionally generated so that the first body 110 may float from the second body 120.

In some exemplary embodiments, the first body 110 may be a carrier and the second body 120 may be a rail. The first body 110 may linearly move above the second body 120 after floating from the second body 120.

In another exemplary embodiment, the linear electromagnetic actuator 100 may be used as a bearing to attenuate fluctuation of a device that needs to move along an orbital motion.

Figure 10B:
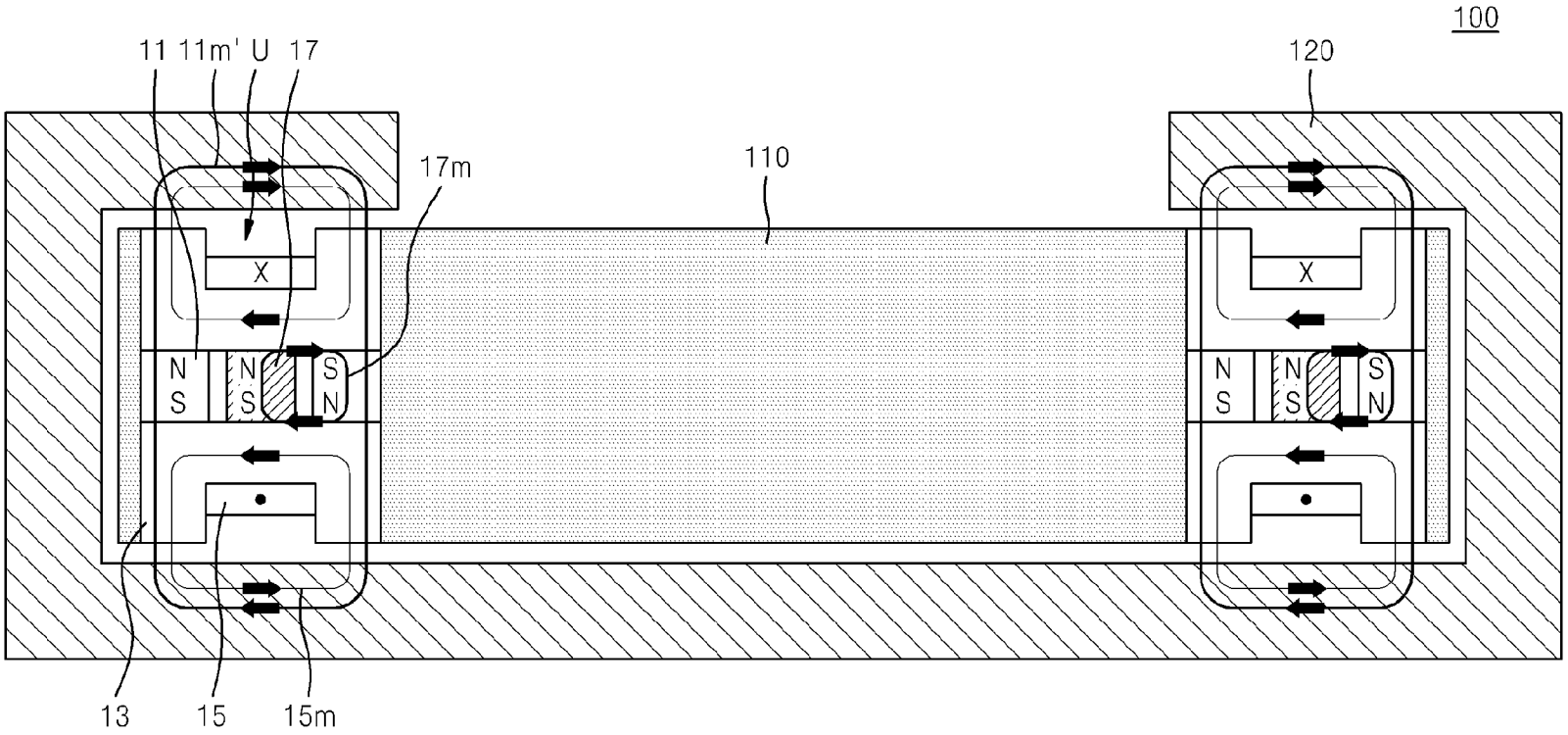

FIG. 10B is a cross-sectional view of the linear electromagnetic actuator 100 to another exemplary embodiment.

Referring to FIG. 10B, the linear electromagnetic actuator 100 is in a state where the first body 110 floats from the second body 120 by applying a bias current to the electromagnetic actuator 100. An outer wall of the first body 110 faces an inner wall of the second body 120. The first body 110 includes a hole for connecting upper and lower portions thereof to each other, and the electromagnetic actuator unit U is disposed in the hole so as to face the second body 120.

The electromagnetic actuator unit U included in the linear electromagnetic actuator 100 of FIGS. 10A and 10B may be the electromagnetic actuator 10 shown in FIGS. 1A through 1C. That is, the biased permanent magnet 11 included in the first body 110 forms the permanent magnet path 11*m*' passing through the core 13 and the second body 120. When the bias current is applied to the coil 15, the electromagnetic path 15*m* passing through the core 13 and the second body 120 is formed. In the upper portion of the second body 120, the magnetic flux density is increased because the permanent magnet path 11*m*' and the electromagnetic path 15*m* is reinforced, and in the lower portion of the second body 120, the magnetic flux density is decreased because the permanent magnet path 11*m*' and the electromagnetic path 15*m* is cancelled. Therefore, the first body 110 floats from the lower portion of the second body 120 to the upper portion of the second body 120 due to the electromagnetic force.

During the above processes, the magnetic path control permanent magnet 17 that is disposed adjacent to the biased permanent magnet 11 forms the induced magnetic path 17*m* so that a part of the magnetic flux produced by the biased permanent magnet 11 may detour the inside of the first body 110. Accordingly, the magnetic flux intensity of the permanent magnet path 11*m*' is reduced, and the first body 110 may easily float.

Figure 11A:
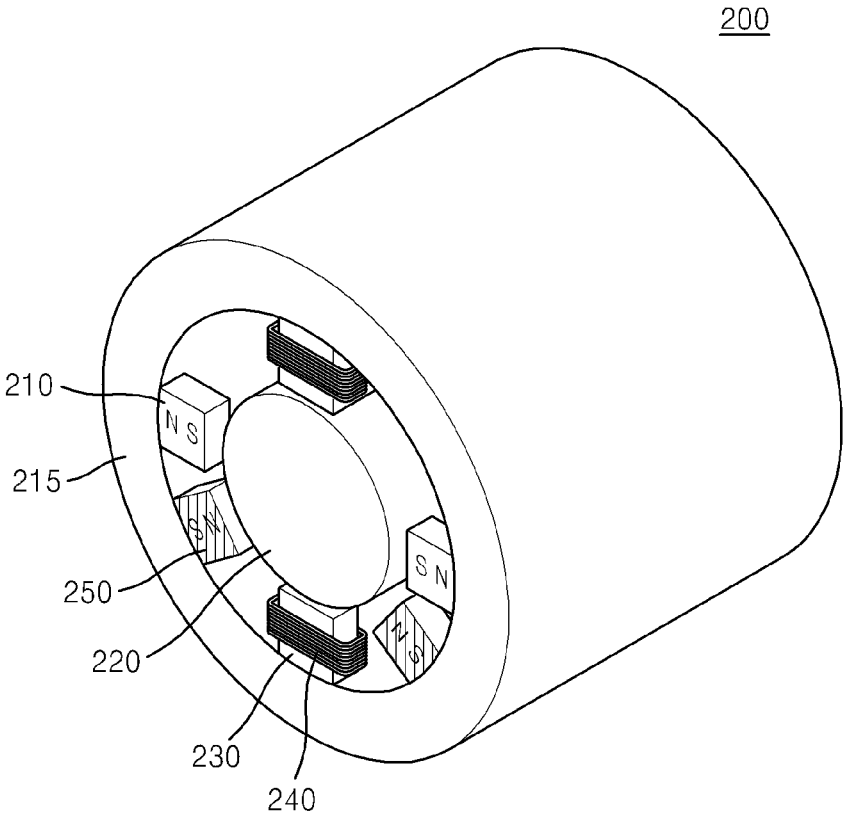
FIGS. 11A and 11B are a perspective view and a cross-sectional view of an electromagnetic actuator for rotary movement, according to the exemplary embodiments.

FIG. 11A is a perspective view of a rotational electromagnetic actuator 200 according to an exemplary embodiment.

Figure 11B:
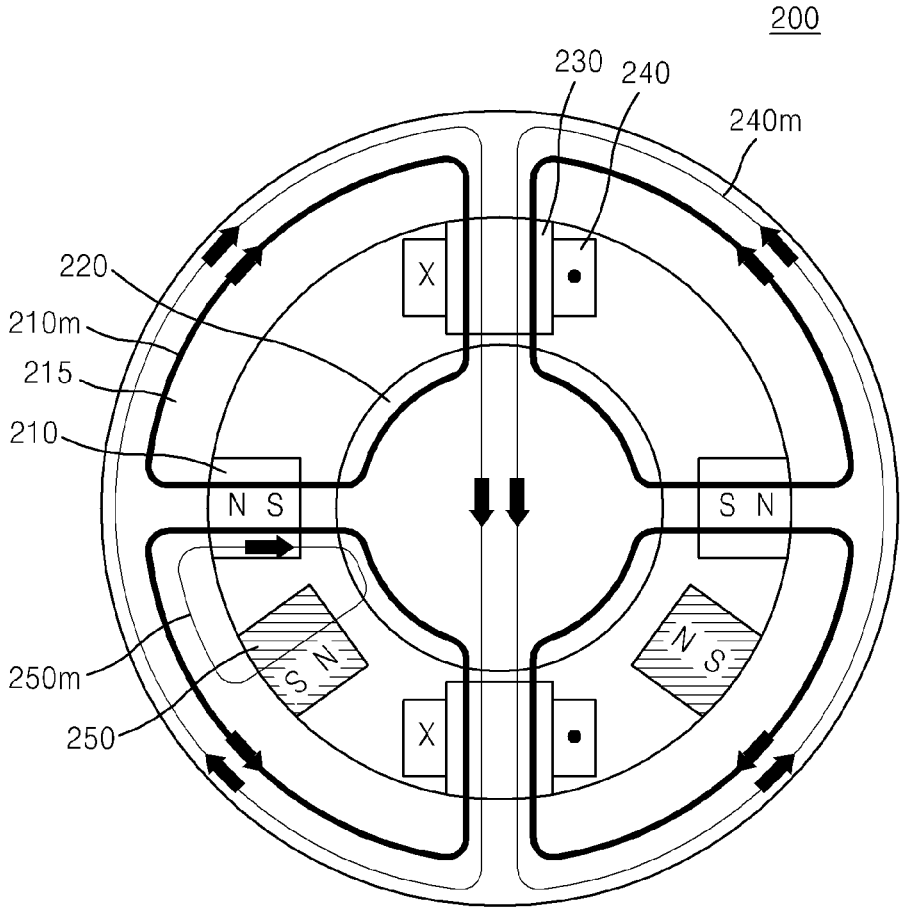

Referring to FIG. 11A, the rotational electromagnetic actuator 200 includes a first body formed as a hollow cylinder 215 and a second body that is a rotating object 220. In FIGS. 11A and 11B, the rotating object 220 floats from the hollow cylinder 220 by applying the bias current to the rotational electromagnetic actuator 200.

Two biased permanent magnets 210 face the rotating object 220 and are connected to the hollow cylinder 215 so as to be symmetric with each other with respect to an axis of the hollow cylinder 215. Magnetic path control permanent magnets 250 are disposed adjacent to the biased permanent magnets 210.

Two electromagnets are connected to the hollow cylinder 215 so that the rotating object 220 floats from the hollow cylinder 215 when the bias current is supplied. Each of the electromagnets includes a core 230 and a coil 240 wound on the core 230. The two electromagnets may be disposed to be symmetric with each other with respect to the axis of the hollow cylinder 215 so that the rotating object 220 may stably float.

In FIG. 11A, two biased permanent magnets 210, two magnetic path control permanent magnets 250, two cores 230, and two coils 240 wound on the two cores 230 are shown. However, the exemplary embodiments are not limited thereto. That is, three or more of these components may be used.

FIG. 11B is a cross-sectional view of the rotational electromagnetic actuator 200 according to another exemplary embodiment.

Referring to FIG. 11B, a floating state of the rotational electromagnetic actuator 200 will be described below in accordance with a permanent magnet path 210*m* produced by the biased permanent magnet 210, an electromagnetic path 240*m* produced by the coils 240, and an induced magnetic path 250*m* produced by the magnetic path control permanent magnet 250.

The permanent magnet path 210*m* is formed to pass through the hollow cylinder 215 connected to the biased permanent magnet 210, the core 230 connected to the hollow cylinder 215, and the rotating object 220 facing the core 230. In FIG. 11B, the permanent magnet path 210*m* may include four magnetic paths.

When a bias current is supplied to the coil 240 wound on the core 230, the electromagnetic path 240*m* passing through the core 230 and the hollow cylinder 215 is formed. The electromagnetic paths 240*m* are formed on left and right sides of the hollow cylinder 215 with respect to the axis of the hollow cylinder 215. The magnetic flux density is increased in an upper portion of the hollow cylinder 215 because the permanent magnet path 210*m* and the electromagnetic path 240 is reinforced in an upper portion of the hollow cylinder 215, and the magnetic flux density is decreased in a lower portion of the hollow cylinder 215 because the permanent magnet path 210*m* and the electromagnetic path 240*m* are cancelled in a lower portion of the hollow cylinder 215. Therefore, the rotating object 210 floats from the lower portion of the hollow cylinder 215 to the upper portion of the hollow cylinder 215 due to the electromagnetic force.

During the above processes, the magnetic path control permanent magnet 250 disposed adjacent to the biased permanent magnet 210 forms the induced magnetic path 250*m* so that a part of the magnetic flux produced by the biased permanent magnet 210 detours inside the hollow cylinder 215. Thus, the magnetic flux intensity of the permanent magnet path 210*m* may be reduced. Accordingly, the magnetic flux intensity of the electromagnetic path 250*m*, which is necessary to cancel the magnetic flux intensity of the permanent magnet path 210*m*, is also reduced. Therefore, a magnitude of the bias current supplied to the coil 240 for floating the rotating object 220 may be reduced in the electromagnetic actuator 200.

In another exemplary embodiment, the rotational electromagnetic actuator 200 may be used as a bearing to reduce fluctuation of a rotating device.

While the inventive concept has been particularly shown and described with reference to exemplary embodiments thereof, it will be understood that various changes in form and details may be made therein without departing from the spirit and scope of the following claims.

What is claimed is:

1. An electromagnetic actuator comprising:

a first body which comprises a core comprising a first core portion and a second core portion which are spaced apart each other in a first direction, a biased permanent magnet disposed in a space between the first core portion and the second core portion, a magnetic path control device which is disposed beside the biased permanent magnet along a second direction perpendicular to the first direction and in the space between the first core portion and the second core portion to adjust a magnetic path produced by the biased permanent magnet, and a coil which is wound on the first core portion and the second core portion to reinforce or cancel the magnetic path produced by the biased permanent magnet; and a second body which is separated from the biased permanent magnet and the magnetic path control device when at least one among the first core portion and the second core portion is between the second body and at least one among the biased permanent magnet and the magnetic path control device;

wherein each of the first core portion and the second core portion includes a C-shaped magnetic member including:

protrusions extending toward the second body, and a central portion which connects the protrusions and is proximate the biased permanent magnet and the magnetic path control device.

2. The electromagnetic actuator of claim 1, wherein the magnetic path control device is a permanent magnet.

3. The electromagnetic actuator of claim 1, wherein the magnetic path control device is an electromagnet.

4. The electromagnetic actuator of claim 1, wherein the coil is wound to surround the first core portion and the second core portion.

5. The electromagnetic actuator of claim 1, wherein the coil is respectively wound on each of the first core portion and the second core portion.

6. The electromagnetic actuator of claim 1, wherein each of the first core portion and the second core portion includes a plurality of protrusions which protrude toward the second body so that the magnetic path produced by the biased permanent magnet passes through the second body, and the coil is wound on at least one of the protrusions.

7. The electromagnetic actuator of claim 1, wherein the first body is a carrier and a second body is a rail.

8. The electromagnetic actuator of claim 1, wherein the magnetic path control device makes a portion of the magnetic path pass through the biased permanent magnet only instead of both the biased permanent magnet and the second body.

9. The electromagnetic actuator of claim 1, wherein the second body includes a first member and a second member between which the first body is disposed, and each of first core portion and the second core portion includes:

an inner surface disposed proximate the biased permanent magnet and the magnetic path control device, and an outer surface disposed proximate the first member or the second member, respectively.

* * * * *